United States Patent [19]

Moore, Jr.

[11] 4,173,451

[45] Nov. 6, 1979

[54] DOWNHOLE PUMP

[75] Inventor: Harold Moore, Jr., Dallas, Tex.

[73] Assignee: Reserve Oil, Inc., Denver, Colo.

[21] Appl. No.: 904,022

[22] Filed: May 8, 1978

[51] Int. Cl.[2] ..... F04B 19/02

[52] U.S. Cl. ..... 417/457; 417/466; 417/469

[58] Field of Search ..... 417/466, 469, 498, 457, 417/490

[56] References Cited

U.S. PATENT DOCUMENTS

| | | | |
|---|---|---|---|
| 1,175,970 | 3/1916 | Michaelson | 417/466 |
| 1,742,579 | 1/1930 | Childers | 417/466 |
| 2,307,451 | 1/1943 | Coberly | 417/466 |
| 2,620,737 | 12/1952 | Miller | 417/466 |
| 3,578,886 | 5/1971 | Nino | 417/435 X |

*Primary Examiner*—Carlton R. Croyle
*Assistant Examiner*—Leonard E. Smith
*Attorney, Agent, or Firm*—Richards, Harris & Medlock

[57] ABSTRACT

An improved downhole pump includes a pump body connected to the lower end of tubing extending inside a well. Pumping is effected below the standing valve by a plunger reciprocating within a slidable barrel. In one embodiment, the ported barrel is magnetically responsive to stroking of the plunger to define a closed volume on the upstroke and a vented volume on the downstroke, whereby gas lock is eliminated. In another embodiment, the barrel is mechanically responsive to the plunger.

13 Claims, 7 Drawing Figures

DOWNHOLE PUMP

BACKGROUND AND SUMMARY OF THE INVENTION

The present invention relates generally to a reciprocating pump. More particularly, this invention concerns an improved downhole pump for producing a well.

In elevating a subsurface fluid, a pump is positioned within a wellbore and adjacent to a geological formation containing the fluid. The downhole pumps of the prior art have traditionally comprised a plunger reciprocating within a pump barrel located at or near the end of tubing extending downward through the casing of the well. The downhole pumps of the prior art are generally characterized by the use of two independent valves to accomplish the pumping action. A standing check valve is secured in the pump barrel beneath the plunger, which includes a traveling check valve. The upstroke of the plunger opens the standing valve and draws fluid into the pump barrel as the traveling valve remains closed. The downstroke of the plunger opens the traveling valve and forces upward the fluid from the pump barrel as the standing valve remains closed. The fluid is thus raised through the tubing by repeated pump cycles.

The downhole pumps of the prior art function satisfactorily with liquids only, but are prone to a condition known as gas lock when pumping a combination of liquid and gas. In a gas lock condition, gas trapped in the pump barrel simply expands or compresses with reciprocation of the plunger so as to prevent operation of either the standing valve or the traveling valve. The pressure within the pump barrel locks the standing and traveling valves closed. Oscillation of the plunger is thus ineffectual to accomplish pumping because both valves stay closed. Production of the well must then be interrupted to relieve the gas lock condition, which is time consuming and therefore expensive. Since crude oil is usually accompanied by natural gas, it will be appreciated that gas lock is a problem of considerable magnitude in the petroleum industry. There is thus a need for a new and improved downhole pump of no susceptibility to gas lock.

The present invention comprises an improved downhole pump which overcomes the foregoing and other problems which have plagued the prior art. In accordance with the general aspects of the invention, there is provided a downhole pump which accomplishes pumping by positive displacement below the standing valve and in the absence of a traveling valve. The volume defined by a plunger and a slidable pump barrel is vented on the downstroke of each pump cycle. The downhole pump of the invention is therefore immune to gas locking and is capable of operation in the presence of a mixture of incompressible and compressible fluids. Use of the downhole pump of the present invention results in greater pumping efficiency and eliminates the expenses which would otherwise be incurred by interrupting production of a well to relieve a gas lock condition.

In accordance with more specific aspects of the invention, an improved downhole pump includes a pump body for attachment to the end of tubing arranged in the casing of the well. A pump barrel extending from the bottom end of the pump body is slidably mounted for axial movement responsive to stroking of a plunger or piston. The pump barrel can be either magnetically or mechanically responsive to movement of the piston. Ports are provided in the pump barrel for fluid communication. The plunger or piston inside the pump barrel is reciprocated by a plunger rod extending through the center of the pump body. On the upstroke, the pump barrel moves upward to the limit of its travel until certain of the ports in the barrel register with passageways leading to the top of the pump body and having check valves located therein. The fluid in the pump barrel is thus positively displaced upwardly by the piston. On the downstroke, the pump barrel moves downwardly to the lower limit of travel closing the passageways in the pump body and opening the ports in the pump barrel to vent any incompressible fluid trapped therein. Due to the self-relieving design and the fact that the lifting action takes place below the standing valve, pumping of liquids and gases in combination can be accomplished without gas lock by means of the improved downhole pump of the present invention.

DESCRIPTION OF THE DRAWINGS

A more complete understanding of the invention can be had by reference to the following Detailed Description in conjunction with the accompanying Drawings, wherein.

DETAILED DESCRIPTION

Figure 1:
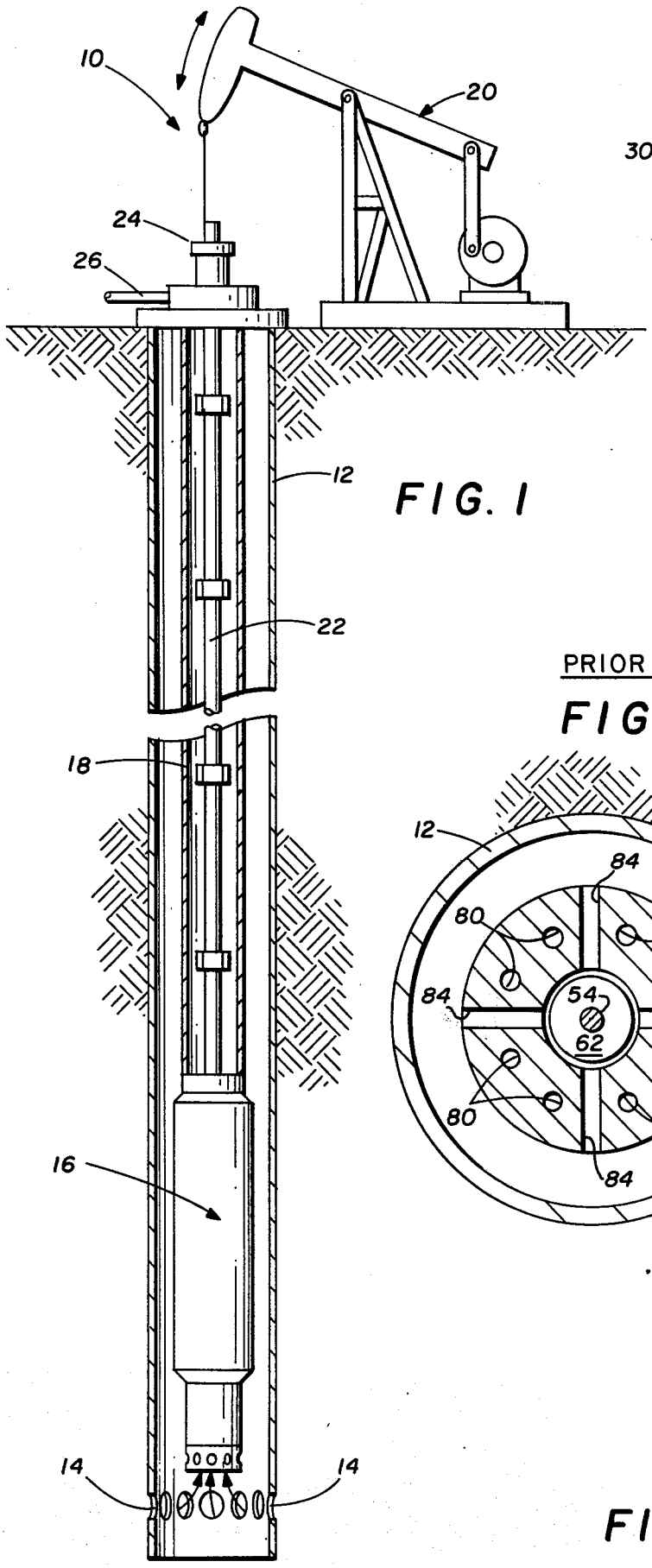
FIG. 1 is a diagram of a well incorporating a downhole pump.

Referring now to the Drawings, wherein identical reference numerals designate like or corresponding parts throughout the several views, and particularly referring to FIG. 1 there is shown a well 10 in which the pump device of the present invention can be utilized. The well 10 includes a casing 12 which is placed within the raw hole after drilling to prevent cave-in of the hole. The casing 12 thus extends downwardly from the surface through the various geological formations or zones. Usually, the casing 12 is cemented in place to prevent cross flow of subsurface fluids between formations. A number of performations 14 are made in the casing 12 adjacent to or preferably below the particular formation from which fluid is desired to be produced. The fluid is thus able to enter the casing 12 and fill at least a portion thereof. A pump 16 for elevating the subsurface fluid is then submerged in the fluid within the casing 12. The pump 16 is supported by tubing 18 extending within the casing 12. A conventional pumpjack 20 situated on the surface actuates the pump 16 through a string of interconnected sucker rods 22 extending inside the tubing 18. Through repeated oscillations of the pumpjack 20, the production fluid is forced by the pump 16 upwardly within tubing 18 toward the wellhead 24, which includes a conduit 26 forming a fluid outlet.

Figure 2:
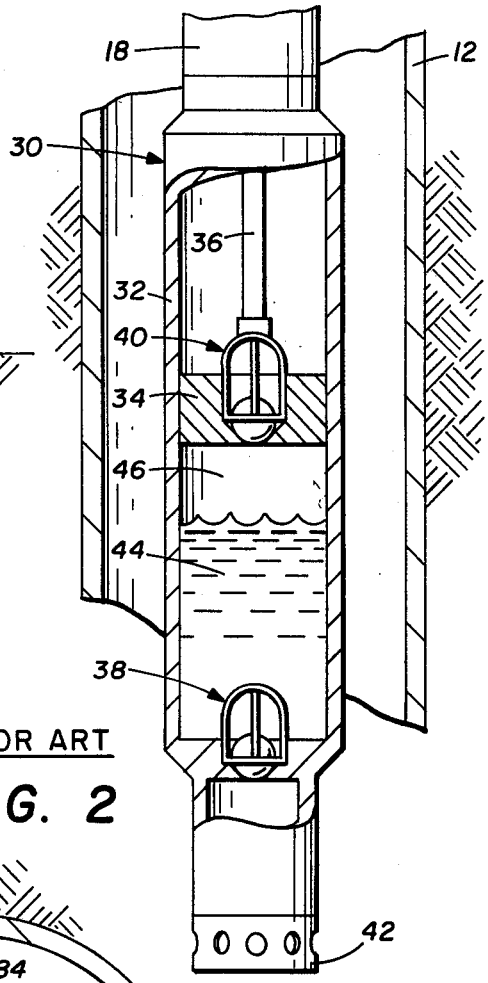
PRIOR ART FIG. 2
FIG. 2 is a diagram of a downhole pump typical of the prior art.
Figure 5:
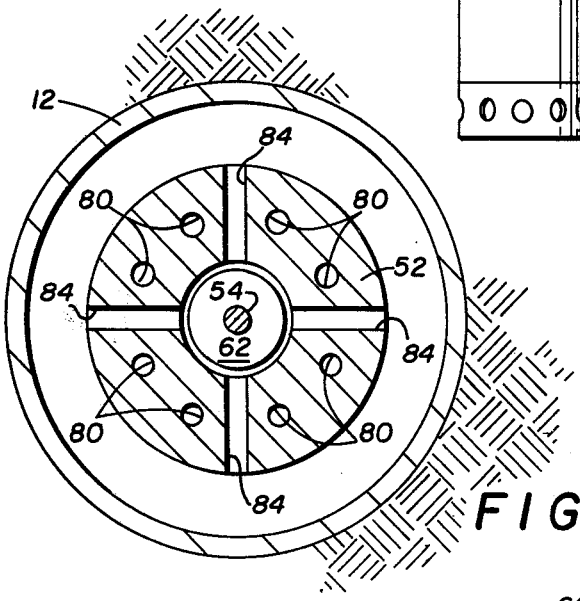
FIGS. 5 and 6 are horizontal cross-sectional views taken generally along the lines 5—5 and 6—6, respectively, of FIG. 3.

FIG. 2 illustrates a pump 30 representative of the prior art pumps which have been utilized for the pump 16 shown in FIG. 1. Pump 30 comprises a stationary pump barrel 32 in which a plunger or piston 34 reciprocates. The piston 34 is sealingly engaged within pump barrel 32 to define a variable volume therein. The piston 34 is connected to the sucker rods 22 by means of a piston rod 36. A standing check valve 38 is provided in the bottom of the pump barrel 32, with a traveling check valve 40 included in the piston 34. Usually, a perforated cup or screen 42 is secured over the pump 30 to prevent induction of rocks, pebbles and other debris. The upstroke of piston 34 opens the standing valve 38 and thus draws fluid inside the pump barrel 32. Valve 40 is, of course, closed during upstroke of the piston 34. On the downstroke, the valve 38 closes to trap the fluid within pump barrel 32, as valve 40 opens so that the piston 34 can plunge into the fluid and thus raise the fluid on the next upstroke. Consequently, a volume of fluid is first trapped in the prior art pump 30, and then forced to the upper side of piston 34 by repeated strokes to accomplish elevation of the fluid.

The prior art pump 30 functions as described only in the company of predominantly incompressible fluid. However, the pump 30 can stall when a volume of incompressible fluid 44 becomes trapped with a volume of compressible fluid 46 as shown in FIG. 2. For example, air and water or natural gas and crude oil could become trapped in a pump such as pump 30. If sufficient compressible fluid 46 is trapped therein, the piston 34 simply oscillates or yo-yos with the expansion and compression of the gas. This results in a gas lock condition wherein the valves 38 and 40 remain closed whereby pumping is impossible. Pumping cannot resume until alleviation of the gas lock. This usually requires at least shutting down the well until sufficient fluid accumulates therein to develop the necessary fluid pressure head, and sometimes may require complete retrieval of the sucker rods 22, the tubing 18 and the pump 30.

Referring now to FIGS. 3–6, there is shown an improved downhole pump 50 incorporating one embodiment of the present invention. The pump 50 can be employed in place of pump 16 shown in FIG. 1 and is adapted for attachment to the lower end of a length of tubing 18 extending within a well. The pump 50 of the present invention is self-relieving and accomplishes pumping below the standing valve without any traveling valve whatsoever. Use of the downhole pump 50 results in greater pumping efficiency by eliminating interruptions caused by gas lock.

The pump 50 includes a pump body 52 through which a piston rod 54 is slidably received. The upper end of piston rod 54 is attached to the string of sucker rods. The piston rod 54 is sealingly engaged by a longitudinal bore 56. In the preferred construction of the pump 50, sealing engagement between the rod 54 and bore 56 is accomplished by a close tolerance fit therebetween. Alternatively, a conventional O-ring (not shown) could be provided in a circular groove in the bore 56 to maintain a fluid seal with the rod 54.

The bore 56 interconnects upper and lower counterbores 58 and 60, respectively, in pump body 52. Upper counter bore 58 opens into the interior of tubing 18. Lower counterbore 60 opens onto the lower end of pump body 52 and receives the upper, closed end of pump barrel 62. The pump barrel 62 is slidably disposed in counterbore 60 about piston rod 54. In accordance with the preferred construction of the invention, barrel 62 is sealingly engaged in counterbore 60 and about rod 54 by means of a close tolerance fit. Alternatively, conventional O-ring seals (not shown) could be used if desired. In addition, barrel 62 preferably has an open bottom and is formed of a material, such as steel, which is responsive to magnetic attraction. A plunger or piston 64 attached to the lower end of piston rod 54 is slidably disposed within pump barrel 62. An outer protective sleeve 66 surrounds barrel 62 and is affixed to the lower end of pump body 52. Preferably, a screen 68 is provided across the lower end of sleeve 66 to preclude intake of gravel and other solid matter.

Figure 6:
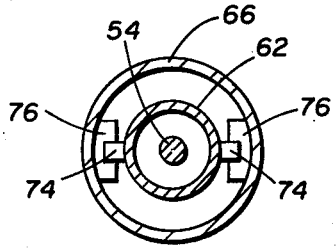
Figure 3:
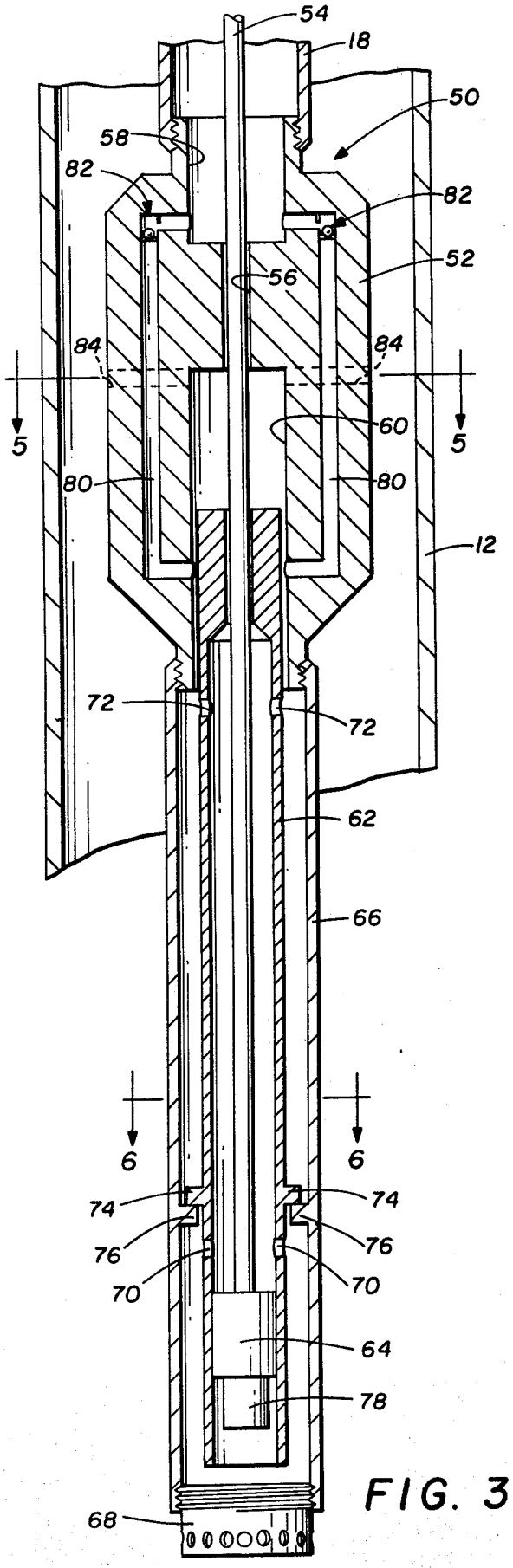
FIGS. 3 and 4 are vertical cross-sectional views of an improved downhole pump incorporating one embodiment of the invention.

FIG. 3 depicts the components of pump 50 in the full downstroke position. In this position the piston 64 is located beneath lower ports 70 provided in the pump barrel 62. Upper ports 72 of barrel 62 are positioned outside of pump body 52. It will be appreciated that ports 70 and 72 of pump barrel 62 permit fluid communication between the interiors of outer sleeve 66 and pump barrel 62. As is best shown in FIG. 6, stops 74 on barrel 62 engage stops 76 on outer sleeve 66 in the full downstroke position. Stops 74 and 76 thus limit the outward travel of pump barrel 62.

Figure 4:
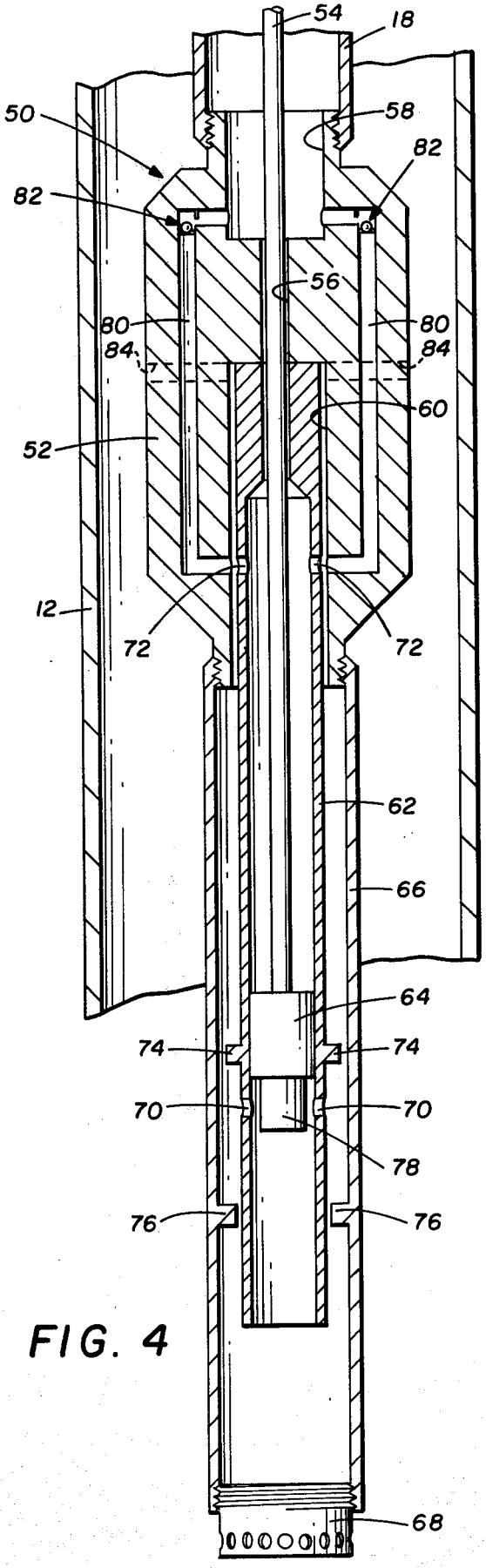

Responsive to upstroke of the piston 64, barrel 62 is displaced upwardly to the position shown in FIG. 4. This is accomplished in the preferred embodiment by means of a magnet 78 secured to piston 64. It will be understood that the use of a magnet to effect movement of barrel 62 comprises a significant feature of the invention. Utilization of magnetic attraction eliminates some points of wear between piston 64 and barrel 62 which might otherwise be present if these components were mechanically interconnected. The magnetic field of magnet 78 seizes pump barrel 62 and thus draws barrel 62 to its upper limit wherein upper ports 72 register with fluid passageways 80 in pump body 52. Passageways 80 interconnect lower counterbore 60 with upper counterbore 58. Positioned within each passageway 80 is a check valve 82 which corresponds to the standing valve for pump 50. Check valves 82 are of conventional construction, such as the caged ball-type valve. Check valves 82 are positioned within passageways 80 to permit upward fluid flow only.

It will thus be apparent that as piston 64 continues moving upwardly beyond lower ports 70 in pump barrel 62, the fluid trapped therein is forced through passageways 80 past open check valves 82 and into tubing 18. On reaching the top of its stroke, piston 64 reverses direction whereby check valves 82 close to prevent back flow of fluid from tubing 18. Pump barrel 62 is again magnetically engaged with piston 64 and moved downwardly until contact between stops 74 and 76. Upper ports 72 and pump barrel 62 are thus reopened to relieve any gas which may have been trapped inside barrel 62. Further downstroke of piston 64 draws fresh fluid into pump barrel 62 through ports 72. Any remaining gas which might still be trapped in barrel 62 is relieved as piston 64 passes beyond lower ports 70 and reverses direction again for the next upstroke. Preferably, cross bores 84 are provided between lower counterbore 60 and the outside of pump body 52 to alleviate back pressure due to tranlation of barrel 62 within counterbore 60. It will thus be appreciated that with each pump cycle fluid is trapped within pump barrel 62 and lifted from a point beneath standing check valves 82, followed by venting of the interior of barrel 62 to relieve any gas buildup.

Figure 7:
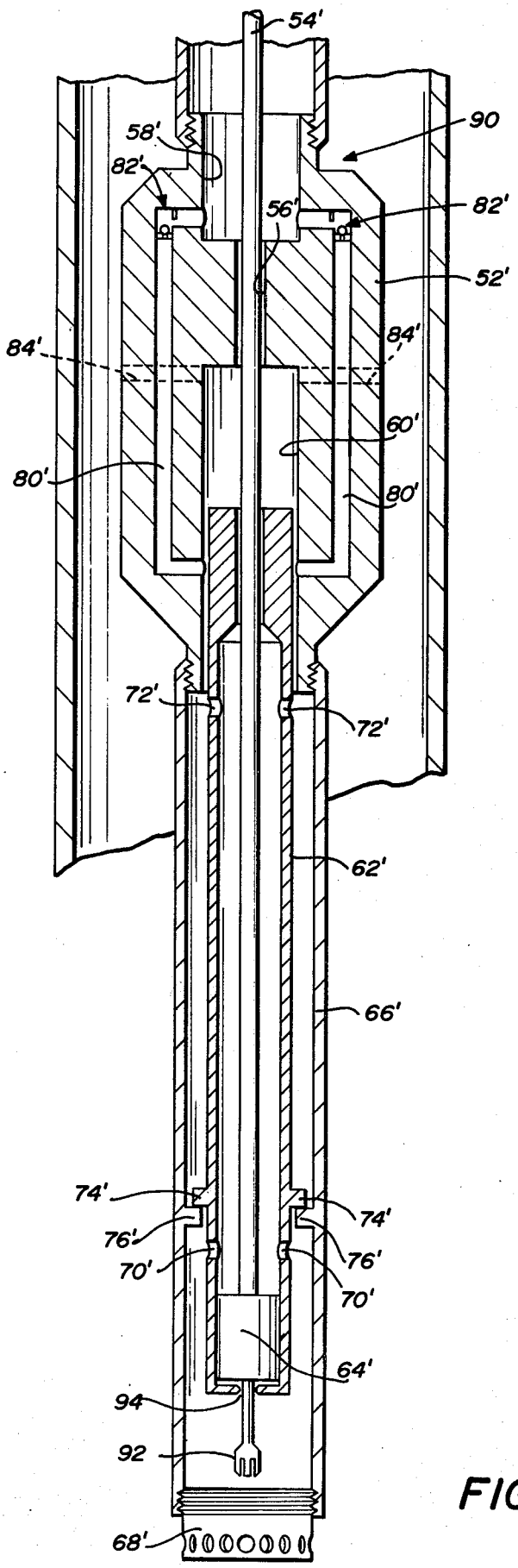
FIG. 7 is a vertical cross-sectional view of another embodiment of the invention.

Referring now to FIG. 7, there is shown a downhole pump 90 incorporating another embodiment of the invention. Downhole pump 90 includes many component parts which are substantially identical in construction and in operation to the component parts of pump 50 illustrated in FIGS. 3 and 4. Such identical components are designated in FIG. 7 with the same reference numeral utilized in the description of pump 50, but are differentiated therefrom by means of a prime (') designation.

The chief distinction between pump 90 and pump 50 is the use of a mechanical connection between piston 64' and slidable barrel 62'. As an example of a suitable mechanical type connection which can be utilized in place of the magnet of pump 50, pump 90 is shown equipped with a collett 92 extending downwardly from piston 64'. Collett 92 is of conventional construction and comprises a plurality of spring loaded fingers which can be caused to pass through a restriction upon application of sufficient force. A restriction 94 is provided across the lower end of pump barrel 62' for receiving collett 92. It will thus be apparent that collett 92 and restriction 94 function similarly to a limited lost motion type connection between piston 64' and barrel 62'.

FIG. 7 illustrates the components of pump 90 in the full downstroke position. At the beginning of the upstroke, barrel 62' remains stationary until collett 92 engages restriction 94. Pump barrel 62' then moves with piston 64' until reaching its upper limit wherein ports 72' register with passageways 80', after which collett 92 is pulled through restriction 94 as piston 64' continues the upstroke. After reversing direction piston 64' strokes down drawing barrel 62' therewith by suction until collett 92 engages and is pushed through restriction 94 preparatory to the next upstroke. The collett arrangement is shown in FIG. 7 by way of illustration only. It will be understood that other types of suitable mechanical interconnection techniques could be employed between barrel 62' and piston 64'. In all other respects the downhole pump 90 functions as was described hereinabove with respect to pump 50.

In view of the foregoing, it will be apparent that the present invention comprises an improved downhole pump which incorporates numerous advantages over the prior art. A slidable pump barrel is responsive to movement of the piston by means of magnetic force or mechanical interconnection. The pump barrel includes upper and lower ports to define a closed volume on the upstroke and a vented volume on the downstroke. The pump of the invention is therefore immune to gas locking and is capable of operation in the company of compressible and incompressible fluids. Pumping efficiency is greatly improved because gas lock interruptions cannot occur. Other advantages derived from the use of the invention will readily suggest themselves to those skilled in the art.

Although preferred embodiments of the invention have been illustrated in the accompanying Drawings and described in foregoing Detailed Description, it will be understood that the invention is not limited to the embodiments disclosed, but is intended to embrace any alternatives, modifications, and rearrangements or substitutions of parts or elements as fall within the spirit and scope of the invention.

What is claimed is:

1. A downhole pump, which comprises:

a pump body having upper and lower ends;

means defining fluid passageways interconnecting the ends of the pump body;

check valve means positioned within the fluid passageway means for permitting fluid flow from the lower end to the upper end of the pump body;

a reciprocating piston; and a slidable barrel with a plurality of ports therein extending from the lower end of the pump body in surrounding relationship with the piston, said barrel being responsive to reciprocation of the piston for movement between an inner position wherein certain of the ports are aligned with the fluid passage means, and an outer position wherein all of the ports are outside the pump body.

2. The downhole pump of claim 1 including a sleeve surrounding the barrel and attached to the lower end of the pump body.

3. The downhole pump according to claim 2 further including cooperating stop means affixed to the sleeve and the barrel for limiting outward movement of the barrel.

4. The downhole pump according to claim 2 further including screen means secured across the lower end of the sleeve for preventing induction of debris.

5. The downhole pump of claim 1 wherein the barrel is formed of a magnetizable material and further including magnet means attached to the piston for effecting movement of the pump barrel.

6. The downhole pump of claim 1 wherein the pump barrel includes an axial restriction, and further including collett means mounted for movement with the piston for engagement with the restriction in said barrel for effecting upward movement of said barrel responsive to movement of said piston.

7. A downhole pump for location in a well having a reciprocating string of sucker rods positioned within tubing extending downwardly in the well, said pump comprising:

a pump body having an upper end adapted for connection to the tubing, and a lower end;

said pump body including upper and lower counterbores extending inwardly relative to said body, a central coaxial bore interconnecting said counterbores, and at least one fluid passageway joining said counterbores;

a check valve located within each of the fluid passageways for permitting fluid flow to the upper counterbore;

plunger means comprising a piston affixed to a rod extending through the central bore of the pump body and connected to the string of sucker rods; and a pump barrel extending from the lower counterbore of the pump body and slidably mounted on the plunger means for movement between inner and outer positions responsive to reciprocation of the plunger means;

said pump barrel including upper and lower ports, said upper ports registering with the fluid passageway opening onto the lower counterbore of the pump body during upstroke of the plunger means to permit fluid displacement upwardly into the tubing, and said upper and lower ports being open during downstroke of the plunger means to permit relief and refill of the pump.

8. The downhole pump of claim 7 including at least one crossbore interconnecting the exterior of the pump body and the inner end of the lower counterbore for pressure relief.

9. The downhole pump of claim 7 including an elongate perforated sleeve surrounding the pump barrel and attached to the lower end of the pump body.

10. The downhole pump according to claim 9 further including stop means secured to the pump barrel and the protective sleeve for limiting outward movement of the pump barrel.

11. The downhole pump of claim 7 wherein the barrel is formed of a magnetizable material, and further including a magnet mounted for movement with the plunger means and having a magnetic field sufficient to engage said barrel for movement therewith.

12. The downhole pump of claim 7 wherein the pump barrel includes an axial restriction, and further including collett means mounted for movement with the piston for engagement with the restriction in said barrel for effecting upward movement of said barrel responsive to movement of said piston.

13. A downhole pump for location in a well having a reciprocating string of sucker rods positioned within tubing extending downwardly in the well, said pump comprising:

a pump body having an upper end adpated for connection to the tubing, and a lower end;

said pump body including upper and lower counterbores extending inwardly relative to said body, a central coaxial bore interconnecting said counterbores, and at least one fluid passage way interconnecting said counterbores;

a check valve located within each of the fluid passageways for permitting upward fluid flow;

plunger means comprising a piston affixed to a rod extending through the central bore of the pump body, one end of said rod being connected to the string of sucker rods and the piston being anchored to the other end;

pump barrel extending downwardly from the lower counterbore of the pump body and being slidably mounted on the plunger means for movement between inner and outer positions; and magnet means mounted for movement with the plunger means and having a magnetic field sufficient to engage the pump barrel for limited movement with said plunger means;

said pump barrel being responsive to reciprocation of the plunger means and including a plurality of upper and lower ports, said upper ports registering with the fluid passageways opening onto the lower counterbore of the pump body upon upstroke of the plunger means when said barrel is in the inner position to permit fluid displacement upwardly into the tubing, and said upper and lower ports being open upon downstroke of the plunger means when said barrel is in the outer position to permit refill and pressure relief of the pump.

* * * * *